United States Patent [19]

Warner

[11] 4,189,146

[45] Feb. 19, 1980

[54] GROUP RING TARGET

[76] Inventor: Harold D. Warner, 14542-SR103, Arlington, Ohio 45814

[21] Appl. No.: 891,185

[22] Filed: Mar. 29, 1978

[51] Int. Cl.[2] ..... F41J 1/10; F41J 3/00

[52] U.S. Cl. ..... 273/408; 273/407

[58] Field of Search ..... 273/102 B, 102 S, 102 R, 273/105 A, 102.4; 40/623

[56] References Cited

U.S. PATENT DOCUMENTS

| | | | |
|---|---|---|---|
| 340,788 | 4/1886 | Jory | 40/623 |
| 445,750 | 2/1891 | Gates | 40/623 |
| 654,936 | 7/1900 | Bigsby | 40/623 |
| 1,912,873 | 6/1933 | Vanhoutteghem | 273/102 B |
| 2,397,921 | 4/1946 | Cole | 273/102.4 |
| 3,100,115 | 8/1963 | Breneman | 273/102.4 |
| 4,066,261 | 6/1976 | Stewart | 273/102 B |

FOREIGN PATENT DOCUMENTS

| | | | |
|---|---|---|---|
| 380588 | 7/1964 | Switzerland | 273/102 R |

*Primary Examiner*—Richard C. Pinkham
*Assistant Examiner*—Lawrence E. Anderson

[57] ABSTRACT

An archery target toward which arrows from a bow may be aimed; the target including a circular outer ring having a circular central opening, within which an inner ring may be fitted, the outer ring having hooks on its rear side for hooking around a string or wire wrapped around a bale of hay, and the inner ring having pins on its rear side for sticking into the bale of hay.

1 Claim, 5 Drawing Figures

GROUP RING TARGET

This invention relates generally to archery. More specifically, it relates to an archery target.

A principal object of the present invention is to provide a target consisting of inter-fitting circular members, so that, when a novice is learning the game of archery, and requires a larger target for accommodating his arrows, he can then include the outer ring with the target. However, as his skill becomes advanced, and he can aim his arrows to better hit the bull's eye, he can then dispense with the outer ring, and utilize only the center ring member.

Another object is to provide a group ring in which the ring members are simply made of a flat material, adaptable to be pierced by arrows, and which can be readily secured to a side of a bale of hay, so that the target itself does not require any padding construction upon its rear.

Yet a further object is to provide a group ring, which can be quickly and easily mounted on a side of the bale of hay, and which can be readily interchanged, so as to include or remove the outermost ring, when changing a target size.

Yet a further object is to provide a group ring, which, in a modified design of the invention, includes scoring numerals on each of the rings, so that, depending upon rotational alignment with each other, the rings can produce a variety of different scoring numbers.

Other objects are to provide a group ring, which is simple in design, inexpensive to manufacture, rugged in construction, easy to use and efficient in operation.

These, and other objects, will be readily evident, upon a study of the following specification, and the accompanying drawing, wherein.

Figure 1:
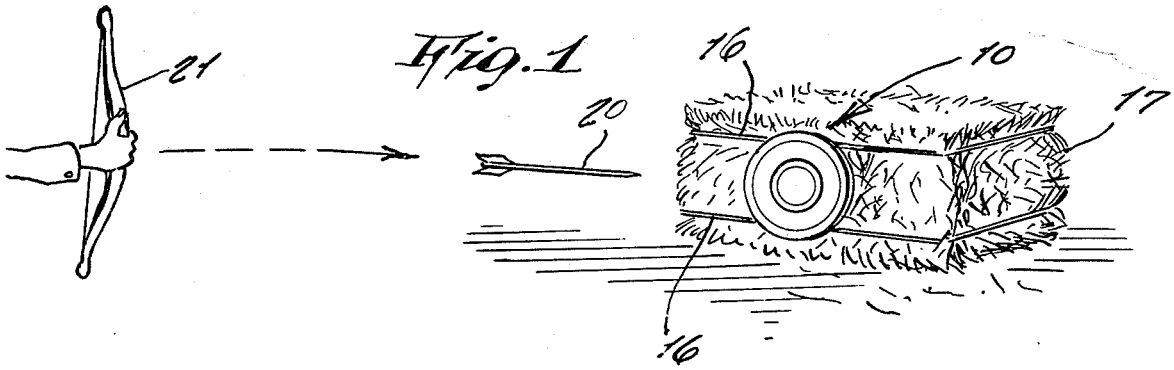
FIG. 1 is a perspective view of the invention, shown mounted on a bale of hay.
Figure 2:
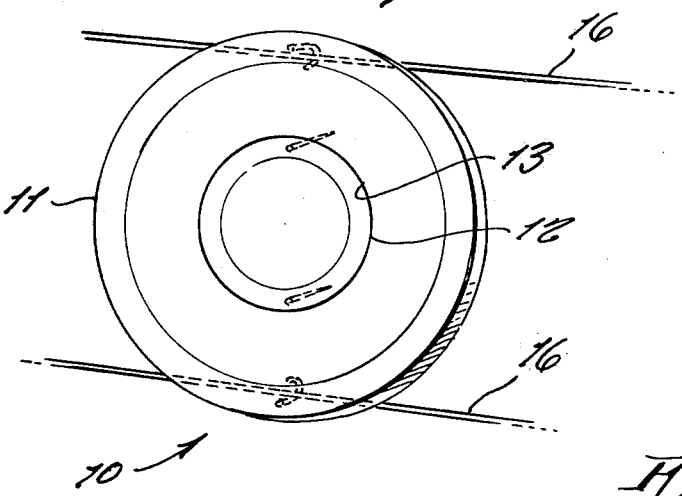
FIG. 2 is an enlarged view of the invention, shown per se.

Referring now to the drawing in greater detail, and more particularly to FIGS. 1 through 4 thereof, at this time, the reference numeral 10 represents a group ring, according to the present invention, and which comprises an outer ring 11 and an inner ring 12. The outer ring comprises a circular member having a circular central opening 13, which is of a size so that the circular outer periphery of inner ring 12 can be readily fitted thereinto.

Upon a rear side 14 of the outer ring, there are a pair of oppositely spaced-apart hooks 15, one of which faces downwardly, and the other upwardly. These hooks are for the purpose of being hooked around strings or wires 16, that are wrapped around a bale of hay 17.

The inner ring 12 is provided with a pair of rearwardly extending pins 18, extending rearwardly from its rear side 19, and which are used for piercing into the bale of hay, in order to support the inner ring therefrom.

Both rings 11 and 12 may be made of any suitable material that is adaptable for being pierced by an arrow

20 shot from a bow 21. Accordingly, such material may comprise inexpensive styrofoam, that is particularly suitable for the task. Each ring comprises a flat member, having a thickness only sufficient in order to remain stiff. However, the thickness of the rings will permit the arrow 20 to penetrate therethrough, and be stopped at its forward end within the bale of hay 17. Thus, the group ring target is considerably less expensive to manufacture than archery targets that require a padding built into the rear side thereof.

In operative use, when a novice is learning the game of archery, he will require a larger target, in order to accommodate all the arrows, so that the target will be used with both inner and outer rings, as shown in FIG. 1. As the skill of the player is increased, and he can group his arrows more closely within the bull's eye of the target, then the player will not require the outer ring 11, so that he will then only mount the inner ring upon the bale of hay, as is shown in FIG. 3 of the drawing.

Figure 3:
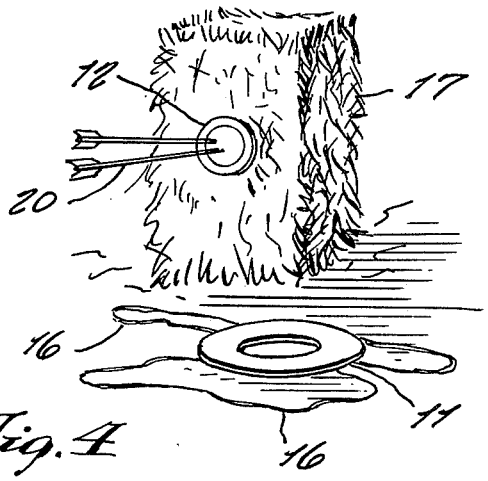
FIG. 3 is a perspective view, illustrating only the inner ring of the target being used, and indicating the bale of hay tilted upright, if so preferred.
Figure 4:
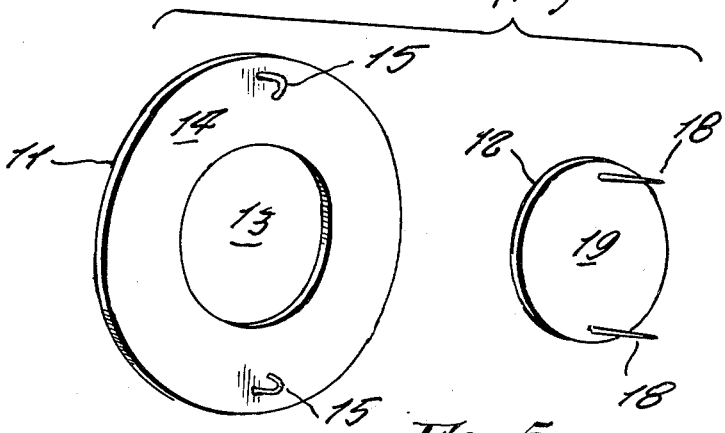
FIG. 4 is a rear perspective view of the rings, shown separated.

As shown in FIGS. 1 and 3, the bale of hay may be placed horizontally or vertically to accommodate the target, as preferred.

The hooks and the pins of the outer and inner targets may comprise metal components, which, at their forward ends, are imbedded within the center of the styrofoam material of the rings.

Figure 5:
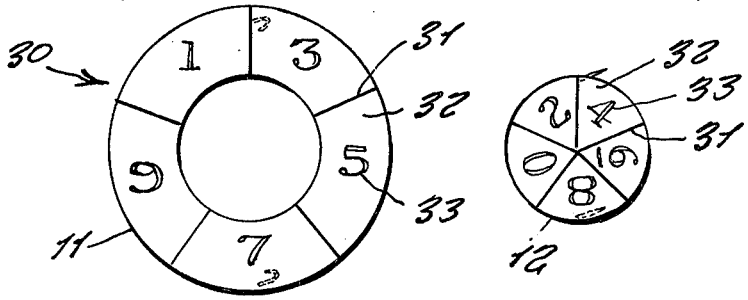
FIG. 5 is a front elevation view of a modified design of the target ring components, each of which is numerically designated for purposes of scoring.

In a modified design of the invention shown in FIG. 5, a group ring target 30 is shown to be a same as the above described group ring target 10. However, in this modified design, each of the rings is additionally imprinted upon its front side with a plurality of radially extending lines 31, so as to define segments 32 therebetween, each of the segments being imprinted with a different numeral 33. The segments of the outer ring are each imprinted with a different odd numeral, whereas the segments of the inner ring are each imprinted with a different even number. The outer ring, with its hooks 15 is, of course, placed against the bale of hay in only one way, whereas the inner ring can be selectively rotated in any direction, so that any one of the numerals upon the inner ring can be aligned with the numerals of the outer ring. Thus, by combining any of the various numbers, there is a selection of 25 different scoring numbers available to a player, so as to give an additional variation to the game.

While various changes may be made in the detail construction, it is understood that such changes will be within the spirit and scope of the present invention, as is defined by the appended claims.

What I now claim is:

1. A grouping target comprising an outer ring and an inner disc, means for said ring and said disc to removably interfit one another, and means for removably mounting said ring and said disc such that they are adapted to be mounted to a bale of hay, said outer ring being circular with a circular central opening sized so as to interfit with the circular periphery of said disc, both said ring and said disc being made of a flat material suitable to be pierced by a projectile, said outer ring having a pair of hooks mounted on its rear side extending rearwardly, each hook adapted to hook onto a string which is wrapped around a hay bale, said inner disc having a pair of rearwardly extending pins adapted to extend directly into and pierce a bale of hay such that said disc is adapted to be mounted either alone or in conjunction with said outer ring, and scoring means provided on said target.

* * * * *